United States Patent [19]

Klein

[11] Patent Number: 4,590,120

[45] Date of Patent: May 20, 1986

[54] TRANSPARENT STATIC REDUCING MAT

[76] Inventor: William G. Klein, 2026 Bay Rd., Stoughton, Mass. 02072

[21] Appl. No.: 691,855

[22] Filed: Jan. 16, 1985

[51] Int. Cl.[4] ..... B32B 7/00

[52] U.S. Cl. ..... 428/247; 428/256; 428/285; 428/520; 428/922

[58] Field of Search ..... 428/922, 247, 256, 285, 428/520

[56] References Cited

U.S. PATENT DOCUMENTS 4,307,144 12/1981 Sanders ..... 428/922

4,472,471 9/1984 Klein ..... 428/922

*Primary Examiner*—Marion E. McCamish

*Attorney, Agent, or Firm*—Charles Hieken

[57] ABSTRACT

A transparent static reducing mat has a transparent plastic substrate. A number of thin conducting essentially invisible fibers are on the substrate in a static-charge-draining conducting layer and are covered by a transparent partially conductive layer of plastic material contacting the conducting layer of thickness much less than the thickness of the transparent substrate.

16 Claims, 5 Drawing Figures

TRANSPARENT STATIC REDUCING MAT

The present invention relates in general to reducing mat static and more particularly concerns novel apparatus and techniques for protecting carpeting with an attractive mat that is relatively free of static.

Chair mats of rigid or semirigid material are widely used to protect carpeting from castered chairs. Clear plastic is preferred because it exposes the color and texture of the underlying carpet and is compatible with any decor. However, chair and foot movement on ordinary plastic create considerable static electricity. The potentials so generated on both individuals and furniture are often high enough to interrupt the operations of electronic data and word processing equipment operated by the person using the chair. Furthermore, the static electricity may contribute to reducing the life of components in the electronic apparatus.

One approach to reducing problems with electrostatically sensitive electronic equipment is to use "computer grade" carpeting that effectively prevents the accumulation of potentially disruptive static charges on those who walk on it. However, this carpeting does not prevent the accumulation of static on a person insulated from the carpeting by a nonconductive plastic mat. Reliable static protection at the office workstation requires that, where a chair mat is used, it be of the anitstatic variety.

A typical prior art approach used conductive black plastics or coatings. While they performed effectively in controlling static, they are unsatisfactory from the standpoint of office decor. Another prior art approach uses a mat in which a conductive printed grid is sandwiched between the main body of the mat and a thin sheet plastic surface such as shown in U.S. Pat. No. 4,472,471. Still another prior art approach uses a conductive grid embossed on the surface of the mat. Although less unattractive than solid black mats, the visible black grid interferes with office decor.

Accordingly, it is an important object of the invention to provide an improved static reducing mat that is less expensive, works better and looks better than prior art mats.

According to the invention, the mat comprises a clear, preferably colorless, plastic base, typically of polyvinyl chloride. This base supports a web of microscopically fine electrostatically conductive fibers, chemically bonded to the surface in a partially conductive polymeric matrix.

According to one process of the invention, an extruder provides hot extruded matting material. A light random web of fine electrically conductive fibers is deposited upon this hot matting material to form a fibered substrate. Immediately thereafter a partially conductive, transparent film is applied to the fibered substrate to form an assembly that enters the chill/embossing rolls. The transparent film is laminated to the fibered substrate by the heat of the extrudate and the pressure of the rolls.

There need be only a sufficient number of fibers in the random orientation such that there is significant electrical contact to render the web, after the surface lamination, essentially equipotential. The conductive web may comprise staple fiber materials made from stainless steel or coated materials such as Badische's 901 filament or Sauquoit's X-Static. The physical size of the material is not critical and is bounded electrically by the need of a longitudinal resistance of not more than about 10 exp 9 ohms/cm and diameters small enough to be essentially invisible in the final product, yet large enough and with a sufficiently low aspect ratio to be handled by available means for distributing them in an essentially random web. Typically, fiber diameters will range from about 0.5 to 2 mils and fiber lengths from 0.25 to 1.5 inches.

The partially conductive film preferably has a volume resistivity of not more than $10^{12}$ ohm-cm and the ability to become firmly bonded to the substrate by the effects of pressure and elevated temperature. Typically, the base material and the top film are essentially PVC material.

Alternatively, instead of using staple fiber to form a random web, an array of generally parallel conductive continuous filaments may be introduced along the direction of motion of the extrudate together with some filaments transverse to the direction of motion to form an interconnected grid that is essentially invisible. Badische 901 material is particularly suited for this embodiment. As still another alternative to staple fibers forming a random web, the unipotential web may be defined by a very light fabric consisting, for example, of a knit structure made with Badische 901 monofilaments bonded to and embedded in the top partially conductive film and the base.

As still another alternative, transparent matting material may be treated with a thin coating of an appropriate adhesive, a random web of conductive fibers laid thereon and a partially conductive transparent top film affixed thereto by pressure alone, or pressure and heat or chemical bonding alone. Alternatively, the web may be first deposited on the thin film and the webbed thin film affixed to the base.

Another way to produce the conductive surface is to coat the standard substrate, possibly in the form of a finished standard mat, with a partially conductive liquid resin to a thickness equal to several times the fiber diameter, randomly sprinkle the conductive fibers on this surface, and followed with an appropriate curing process. If the wetting characteristics of the fibers in the resin, which may be in a water or solvent base, are good enough, the fibers will be "sucked" in to the resin and form a conductive matrix of sufficient mechanical integrity to not require an overcoat. An overcoat of partially conductive resin may be used if the fibers are not sufficiently bonded and covered by the first coat.

According to another aspect of the invention, a significantly conductive film may be made by dispersing fine, conductive staple fibers in either the resin or plastisol before sheet forming. Preferably, the plastic material has the electrical properties for the film materials described above. This film may then be directly laminated to a base by adhesive or thermal/pressure, or other suitable means without the necessity of handling or guiding conductive elements at this stage of the operation.

Numerous other features, objects and advantages of the invention will become apparent from the following specification when read in connection with the accompanying drawing in which.

Figure 1:
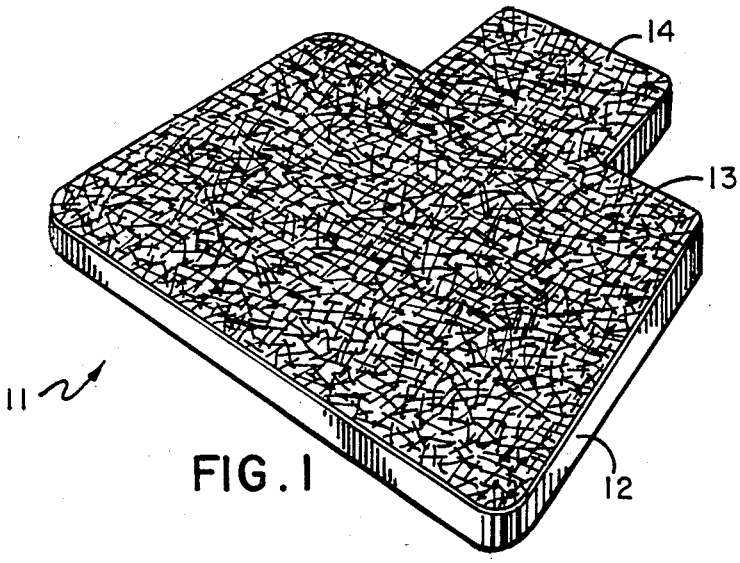
FIG. 1 is a perspective view of an embodiment of the invention using random fibers.

With reference now to the drawing and more particularly FIG. 1 thereof, there is shown a perspective view of a chair mat according to the invention. Chair mat 11 comprises a transparent colorless PVC base 12 covered with a random web 13 of electrically interconnected conducting fine essentially invisible fibers defining an essentially unipotential plane at the top of the mat and covered by a partially conducting transparent layer 14, made of PVC or other compatible plastic. The conductive fibers in random web 13 are shown darker in order to convey the structure of the invention; however, in the actual structure these fibers are essentially invisible, typically comprising staple fiber material of metal or coated materials, such as Badische 901 or X-static. Partially conductive film 14 preferably has a volume resistivity of not more than $10^{12}$ ohms-cm.

Figure 2:
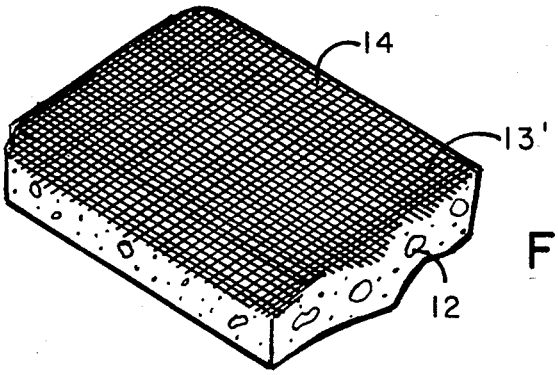
FIG. 2 is a perspective view of another embodiment of the invention using a fiber grid.

Referring to FIG. 2, there is shown a fragmentary view of a portion of a mat illustrating an alternative construction according to the invention. Random web 13 is replaced by grid-like web 13' formed of intersecting orthogonal parallel essentially invisible conductive fibers, darkened in FIG. 2 to convey the nature of the structure.

Figure 3:
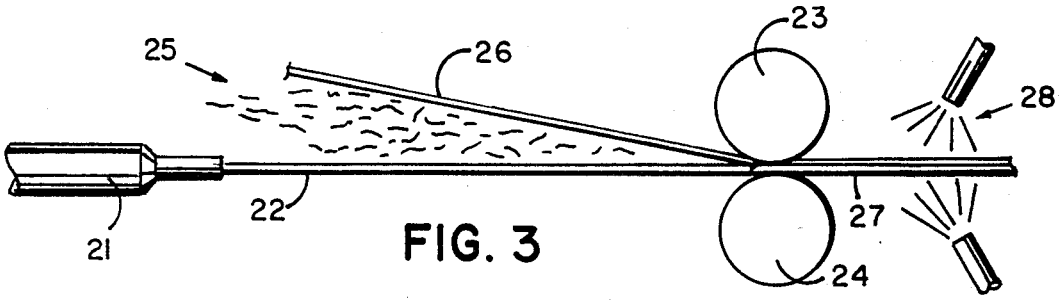
FIG. 3 is a diagrammatic representation of apparatus for practicing one process of the invention.

Referring to FIG. 3, there is shown a diagrammatic representation of a system for practicing the process according to the invention for making the product according to the invention. Extruder 21 expels a hot extrudate 22 of clear colorless transparent material such as PVC that moves toward embossing/chilling rolls 23 and 24. This extrudate corresponds to base 12 in FIGS. 1 and 2. Before extrudate 22 enters chill/embossing rolls 23 and 24, the random web of electrically conductive essentially invisible fibers 25 is deposited on extrudate 22 to form a fibered substrate and is covered by transparent partially conductive layer 26 to form an assembly that is laminated together under the pressure of embossing rollers 23 and 24 while absorbing heat from extrudate 22. Web 25 corresponds to random web 13 in FIG. 1 or grid web 13' in FIG. 2. Transparent partially conductive layer 26 corresponds to partially conductive transparent layers 14 in FIGS. 1 and 2. The embossed laminated assembly 27 may then be further cooled at cooling station 28. Mat 11 may then be stamped or cut from the cooled assembly 27 in accordance with conventional techniques.

Figure 4:
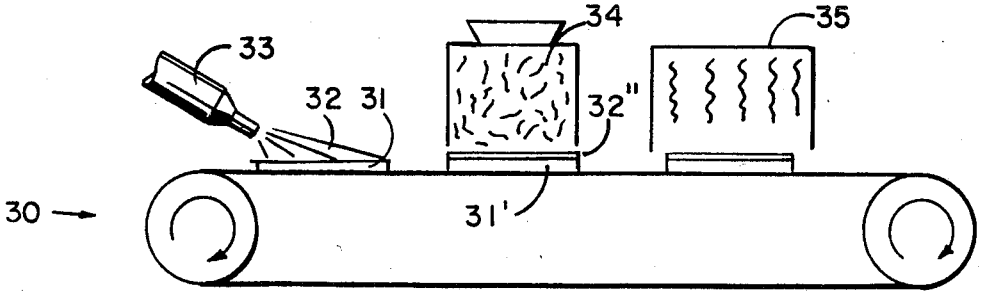
FIG. 4 is a diagrammatic representation of another embodiment of the invention.

Referring to FIG. 4 there is shown a diagrammatic representation of an apparatus 30 for practicing another process of the invention. A finished substrate 31 is first coated with a thin film of aqueous resin, plastisol, or organisol 32 sprayed by nozzle 33 or otherwise coated as by roller or brush. The coated substrate 31' is then randomly showered with conductive fibers 34. The coated filtered substrate 32'' then passes through oven 35 in a heating process sufficient to dry or cure the coating. If necessary, an additional coverage of the fibers using the bonding matrix can be applied either immediately after the deposition of the fibers or as a separate process after the first cure. In this process the conductive layer is essentially homogeneous in which the applied coating serves as a matrix for the fibers rather than a cover.

When making the embodiment of FIG. 2, web 25 is formed by an array of parallel conductive continuous filaments along the direction of movement of extrudate 22 along with an array of parallel conductive filaments perpendicular to the direction of movement of extrudate 22. Alternatively, web 25 might comprise a very light fabric comprising, for example, a knit structure made with Badische 901 monofilaments. As still another alternative, transparent partially conductive layer 26 may be treated with a thin coating of an appropriate adhesive such as pressure sensitive acrylic, and web 25 adhered thereto after passing through chill/embossing rolls 23 and 24, or even after the base mat has been finished.

As another alternative, transparent conducting sheet 26 may be made from a resin emulsion, plastisol, or organasol, e.g., PVC plastisol, having fine conductive staple fibers dispersed therein before the transparent partially conductive sheet is formed and may then be directly laminated to extrudate 22 by entering chill/embossing rolls 23 and 24 and/or using an adhesive to secure the conductively fibered partially conductive transparent film to the transparent base without the need of depositing fibers 25.

As still a further alternative a significantly conductive film may be made in connection with forming partially conductive sheet 26 by randomly depositing conductive fibers on an endless belt, then covering the random fibers on the belt, the fiber plastisol then being doctored and entering a warming oven. Alternatively, the fibers may be randomly deposited immediately after doctoring and before entering the oven, or on the bank behind the doctor.

As still another form the invention may take, conductive fibers may be randomly deposited on extrudate 22 without introducing partially conductive layer 26. The base and conductive fibers embedded therein may be protected later, if desired, by applying either a laminate or a coating composed of partially conducting material compatible with the base.

There has been described a novel product and process for making it characterized by a number of features. A mat according to the invention meets generally accepted industry and equipment manufacture requirements for static protection in floor covering materials. Static generation is believed to be lower than for all previous products, typically much less than 1.0 kilovolt and well below the recognized standard of 2.0 kilovolts as being the maximum computer safe potential. Still another feature of the invention is that its electrical capacity for absorbing static charge is so high that grounding is usually unnecessary. Whether from foot traffic, rolling chairs or externally introduced charges, the static charge on a mat according to the invention remains low enough to prevent malfunction of electronic office equipment, even with the mat ungrounded. The invention may be grounded for unusually demanding applications.

A material made in the same manner as any of the listed embodiments may also be in the form of sheet stock to be used as bench or table top covering and will perform in a manner equal to or superior to existing materials used for this purpose.

Figure 5:
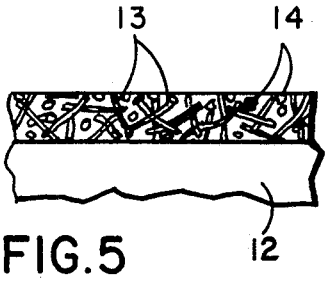
FIG. 5 is a fragmentary sectional view of the invention showing the fibers overlaying each other in different planes.

It is also within the principles of the invention for the matrix of fibers and plastic to be disposed in a transparent layer or the substrate having a thickness much greater than the thickness of a conducting fiber. Referring to FIG. 5, there is shown a fragmentary sectional view of the embodiment of FIG. 1 showing substrate 12 and matrix 13 of fibers and transparent plastic 14 with the fibers randomly oriented in both vertical and horizontal planes when the mat is horizontal.

The invention may typically comprise a transparent colorless PVC base covered with a random web of electrically conductive fibers, in electrically conductive contact, in a plastic matrix made of PVC, or other compatible plastic.

Examples of suitable base materials include, for example, PVC, acrylic and polycarbonate. A suitable cover film is PVC. Suitable cover sprays or coatings include, for example, PVC, acrylic, and urethane. A suitable PVC plastisol for the top layer may include, for example, Markstat nonmigrating conductive plastisizer from Argus Chermical Company. A suitable urethane cover spray may comprise a water based emulsion with Melamine for curing and a suitable wetting agent, such as Rohm and Haas Triton X-100. An acceptable range of apparent surface resistivity for the top layer is from $10^4$ to $10^{10}$ ohms/square, a typical range being $10^6$ to $10^9$ ohms.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A transparent static reducing mat comprising, a transparent base of insulating plastic material having a top surface for carrying the weight of movable loads and a bottom surface for contacting carpeting to be protected, and a plurality of thin conducting essentially invisible electrically interconnected fibers above said base defining a static-charge-draining conducting layer, said mat being transparent so that the color and texture of carpeting or other material when in contact with said bottom surface shows through said top surface and said conducting layer, wherein said thin conducting essentially invisible electrically interconnected fibers are microscopically fine electrostatically conductive fibers chemically bonded to the surface of said transparent base.

2. A transparent static reducing mat in accordance with claim 1 and further comprising, a thin transparent partially conductive layer of plastic material contacting said conducting layer of thickness much less than the thickness of said base, said mat being transparent so that the color and texture of carpeting or other material when in contact with said bottom surface shows through said base, conducting layer and said transparent partially conductive layer.

3. A transparent static-reducing mat in accordance with claim 2 wherein said conducting layer comprises a web of randomly disposed conducting fibers.

4. A transparent static reducing mat in accordance with claim 2 wherein said conducting layer comprises a rectangular grid of fibers.

5. A method of making the product of claim 2 which method includes the steps of, providing a hot extrudate of insulating plastic material, depositing said essentially invisible conductive fibers in said top surface of said hot extrudate and covering the conductive fibers on said top surface with said partially conductive transparent layer to form a transparently covered fibered substrate, and applying pressure between said bottom surface and said cover of said transparently covered fibered substrate and cooling the latter.

6. A method of making the product of claim 2 which method includes the steps of, coating said top surface with liquid resin to form said thin transparent partially conductive layer, depositing said plurality of thin conducting fibers on said resin randomly oriented, and heating the resined fibered base to dry or cure the sprayed coating.

7. A static reducing mat in accordance with claim 2 wherein said conducting layer is between said partially conductive layer and said top surface.

8. A static reducing mat in accordance with claim 2 wherein said conducting layer resides within said partially conductive layer.

9. A transparent static-reducing mat in accordance with claim 1 wherein said conducting layer comprises a web of randomly disposed conducting fibers.

10. A transparent static-reducing mat in accordance with claim 9 wherein the diameter of said fibers is within the range of 0.5 to 2 mils and the fiber lengths are within the range 0.25 to 1.5 inches.

11. A transparent static reducing mat in accordance with claim 1 wherein said conducting layer comprises a rectangular grid of fibers.

12. A method of making the transparent static-reducing mat of claim 1 which method includes the steps of, providing a hot extrudate of plastic insulating material to form a base extrudate having a top surface and a bottom surface, placing said essentially invisible conducting fibers on said top surface while said extrudate is hot to form a fibered hot extrudate, and applying pressure between the top and bottom surface of the fibered extrudate and cooling the fibered extrudate.

13. A static reducing mat in accordance with claim 1 wherein said plurality of thin conducting essentially invisible fibers are randomly oriented in said layer in directions both generally parallel to and generally perpendicular to said top surface.

14. A transparent static-reducing mat in accordance with claim 13 wherein the diameter of said fibers is within the range of 0.5 to 2 mils and the fibers lengths are within the range 0.25 to 1.5 inches.

15. A transparent static-reducing mat in accordance with claim 1 wherein said thin conducting essentially invisible electrically interconnected fibers are microscopically fine electrostatically conductive fibers chemically bonded to the surface of said transparent base in a partially conductive polymeric matrix.

16. A transparent static-reducing mat in accordance with claim 15 wherein the diameter of said fibers is within the range of 0.5 to 2 mils and the fiber lengths are within the range of 0.25 to 1.5 inches.

* * * * *